US006033477A

United States Patent [19]

Ueberschär

[11] Patent Number: 6,033,477

[45] Date of Patent: Mar. 7, 2000

[54] APPARATUS FOR JOINING AT LEAST ONE ACTUATOR TO AT LEAST ONE OBLONG WORKING UNIT OF A COATING SYSTEM, ALLOWING TRANSLATORY AND/OR ROTARY ADJUSTMENT

[75] Inventor: Manfred Ueberschär, Nattheim, Germany

[73] Assignee: Voith Sulzer Papiermaschinen GmbH, Heidenheim, Germany

[21] Appl. No.: 08/991,418

[22] Filed: Dec. 16, 1997

[30] Foreign Application Priority Data

Dec. 18, 1996 [DE] Germany ..... 196 52 857

[51] Int. Cl.[7] ..... B05C 21/00

[52] U.S. Cl. ..... 118/413; 118/126; 118/410; 118/419

[58] Field of Search ..... 118/118, 119, 118/126, 410, 413, 419

[56] References Cited

FOREIGN PATENT DOCUMENTS 195 14 772A1 10/1996 Germany .
195 16 223C2 3/1997 Germany .
2 046 138 11/1980 United Kingdom .

*Primary Examiner*—Laura Edwards
*Attorney, Agent, or Firm*—Taylor & Aust, P.C.

[57] ABSTRACT

An apparatus for joining at least one actuator to at least one oblong working unit of a coating system allows translatory and/or rotatory adjustment. The apparatus includes, in one variant, at least one coupling system joining the actuator and the working unit. The coupling system is configured as a force transmission element which, in at least one axis substantially parallel to the longitudinal expanse of the oblong working unit, is bending-elastic. The coupling system is substantially resistant to tension and compression with respect to the actuating direction of the actuator.

13 Claims, 3 Drawing Sheets

APPARATUS FOR JOINING AT LEAST ONE ACTUATOR TO AT LEAST ONE OBLONG WORKING UNIT OF A COATING SYSTEM, ALLOWING TRANSLATORY AND/OR ROTARY ADJUSTMENT

BACKGROUND OF THE INVENTION

1. Field of the Invention

The present invention relates to an apparatus for joining at least one actuator to at least one oblong working unit of a coating system, allowing translatory and/or rotatory adjustment.

2. Description of the Related Art

In coating systems, such as those of paper machines or paper converting machines, traveling material webs, for example, of paper, cardboard or a textile material, are by use of a suitable applicator provided on one or both sides with one or several layers of a liquid or pasty coating medium, for instance color, starch, impregnating fluid or the like. To produce a maximally uniform and exact coating, such coating systems, notably their applicators, include oblong working units which substantially extend across the entire width of the fiber material web. The working units also serve the direct or indirect manipulation of the coating medium, or adjust or correct a desired length profile and/or cross profile of the coating. Further, the working units allow translatory and/or rotatory adjustment by use of suitable actuators. The actuators may be mechanical, electrical, electromagnetic, magnetic, magnetostrictive, piezoelectric, pneumatic, hydraulic, etc., and are incorporated in a feedback control or a control system. Depending on the configuration of the coating system, an oblong working unit may be, for example, an adjustable lip of an open-jet nozzle applicator, the adjustable walls of an applicator chamber, an adjustable doctor element such as a doctor blade, a roll doctor element or the like, an adjustable doctor element holder, an adjustable pressure bar, an adjustable deflector plate, etc. Working units of this type usually allow uniform adjustment either substantially across the entire machine width or zonewise.

With such coating systems, practice has shown that inaccuracies occur in the assembly of the actuator and the working unit due to manufacturing tolerances as well as offset and angular defects. These inaccuracies cannot later be compensated for, or only at a disproportionately high control expense. In the operation of the coating system, moreover, adjustment inaccuracies and harmful distortion of the actuator and/or working unit result from the above circumstances and not only have a negative effect on the quality of the produced coating, but also lead to an impairment of the function, precision and service life of these components. These unfavorable effects are especially pronounced in the operation of frequently used rotatorily adjusted working units, even with slight manufacturing tolerances and accurate assembly. Furthermore, it has been demonstrated that setting the actuators and working unit as well as connecting and mutually aligning them is a rather time-consuming and cost-intensive process and, due to the circumstances illustrated above, does not always lead to the desired result.

SUMMARY OF THE INVENTION

The invention provides a suitable apparatus for joining at least one actuator to at least one oblong working unit of a coating system, allowing translatory and/or rotatory adjustment. The apparatus avoids the above disadvantages to the greatest possible extent, guarantees an easy, effective and precise joining of the actuator to the working unit, and thus contributes to the production of a high-quality coating.

The apparatus for joining at least one actuator to at least one oblong working unit of a coating system, allowing translatory and/or rotatory adjustment, includes at least one coupling system that connects the actuator and the oblong working element to each other with no backlash. At least one force transmission element is arranged between the coupling system and the actuator and/or between the coupling system and the oblong working unit. The working unit allows elastic bending in at least one axis that is substantially parallel to the longitudinal expanse of the oblong working unit. The force transmission element is substantially resistant to traction and thrust with respect to the actuator of the actuating system.

Depending on the configuration of the apparatus, the force transmission element allowing elastic bending may be positioned between the coupling system and the working unit, between the actuator and the coupling system, or both between the coupling system and the working unit and between the actuator and the coupling system. In the latter case, consequently, there are two bending-elastic force transmission elements provided with an interconnecting coupling system. Coordinated with each individual actuator of the actuating system is a separate coupling system and a separate bending-elastic force transmission element. Also possible, however, is coordinating a common coupling system or common bending-elastic force transmission element with several actuators. The individual components of the inventional apparatus are joined to one another with the aid of suitable fastening devices. Several particular configuration variants of the fastening devices will be addressed hereinafter yet in greater detail. The at least one bending-elastic force transmission element can be a component made of an elastomer material, fiber-composite material, or flexible metallic material or the like with a cross-sectional shape adapted to the aforementioned position of the at least one bending axis and, consequently, to the bending direction. The bending-elastic force transmission element may be fabricated either as a single-piece, integral component, or as a noncompound part composed of several individual components. In the latter variant, the force transmission element may also include substantially rigid structural elements which, in cooperation with one or several elastic or flexible components, guarantee the bending-elastic properties. The coupling system of the apparatus is configured as a fast-action coupling, for example, in the form of a positive clamping, plug-in, slide-plug, snap-in or screw connection. With respect to the direction of actuation, that is, the direction of force effect or force transmission of the actuator system, the selection of the material properties, such as the resistance to traction and thrust and the elasticity of the bending elastic force transmission element and of the apparatus components coordinated with this part, is such that the effect of the actuator remains substantially unaltered. Lastly, the bending-elastic force transmission element also possesses an additional degree of freedom in a direction substantially parallel to the longitudinal expanse of the working unit. The degree of freedom is achievable by suitable shaping or material selection of the force transmission element.

The inventional apparatus provides a connection between the actuator and the working unit that is free of play and is precise. The particular bending-elastic force transmission element that coacts with the actuator, coupling system and working unit compensates, easily and effectively and without negative effects on the coacting components, for manufacturing tolerances as well as any installation inaccuracies. Acting on account of the spring effect of the bending-elastic force transmission element on the connected components of the apparatus, the reaction forces due to the design-specific bending axis, which extends substantially parallel to the longitudinal expanse of the working unit, are negligibly small. At the same time, however, the bending-elastic force transmission is sufficiently rigid with respect to the actuating direction of the actuator to effectively transmit the traction or thrust forces emanating from the actuator to the working unit and actuate it.

The bending-elastic force transmission element effectively compensates for any angular variation caused by an adjustment, such as pivoting the oblong working unit, or for a discrepancy in level resulting therefrom between the actuating direction and the straining point of the actuating force on the working unit. The transmission element achieves this compensation without allowing the buildup of any undesirable harmful stresses on the joined components. This is particularly conductive to the function, actuating accuracy and service life of the actuator and the working unit. Furthermore, the inventional apparatus facilitates the assembly work in the installation of the actuator and the working units, since time-consuming and cost-intensive setting and alignment work is no longer necessary. Lastly, the enhanced precision and reproducibility of the adjustment motions of the actuator and working unit that is achievable with the inventional apparatus also makes it possible to reduce the control expense for the coating system. While a slight change of the actuating path occurs due to the bending-elastic force transmission element, this change can be determined exactly and allowed for appropriately.

According to a configuration feature of the inventional apparatus, the bending-elastic force transmission element is detachably or nondetachably joined to the coupling system, actuator and/or oblong working unit. Depending on the type of joining, a prefabricated assembly and a high degree of standardization can thus be achieved. This leads not only to a simplified assembly but also contributes to a reduction of the overall costs of a coating system equipped with an inventional apparatus.

This apparatus for joining at least one actuator to at least one oblong working unit of a coating system, allowing translatory and/or rotatory adjustment, includes at least one coupling system connecting the actuator and the oblong working unit to each other without play. The coupling system is configured as a force transmission element that is bending-elastic in at least one axis substantially parallel to the longitudinal expanse of the oblong working unit. The force transmission element is also resistant to traction and thrust with respect to the actuating direction of the actuator. The coupling system itself thus assumes the function of the bending-elastic force transmission element described above. Therefore, the parts or sections of the actuator and/or working unit attached to the coupling system may be configured as rigid components. Similarly, it is possible to connect additional bending-elastic elements to the bending-elastic coupling system. This apparatus also possesses the advantages already illustrated in detail.

As already mentioned above, a separate coupling system and a separate bending-elastic force transmission element, which itself may be configured as coupling system, may be coordinated with each individual actuator of the actuating system. Alternatively, several actuators may be assigned a common coupling system and/or common bending-elastic force transmission element. In the latter case it has proved possible to configure, according to a further embodiment of the two aforementioned inventional apparatuses, the coupling system and/or the bending-elastic force transmission element as an oblong component extending substantially parallel to the longitudinal direction of the oblong working unit. Such an oblong component allows a particularly easy and swift attachment of a plurality of actuators of the actuating system to the coupling system or to the bending-elastic force transmission element. Such an oblong component also enables, with an appropriately flexible design of this component in the longitudinal direction of the oblong working unit, that is, in the width direction of the machine, an adjustment of the working unit that is free of play and stress. The adjustment can be both uniform across substantially the entire machine width and zonewise.

In another configuration variant of the inventional apparatus, at least one of the following components features at least one first adapter which without play meshes with at least one second corresponding adapter of at least one other of these components: the bending-elastic force transmission element, the coupling system and the actuating system. The first and second adapters may form a rigid, flexible, rotatable or pivotable connection. The two adapters facilitate the assembly and dismantling of the apparatus components and also the maintenance of a coating system equipped with an inventional apparatus. Also, the adapters promote a standardization of the inventional apparatus and allow employment of bending-elastic force transmission elements, coupling systems and actuating systems in other coating systems equipped with an appropriate type of adapter.

Adapters including a ball head or circular material section mating with a corresponding socket or arcuately recessed material section of an appropriate mating piece are possible. This type of adapter enables a jointed connection of the apparatus components and additional compensation for manufacturing tolerances and any installation defect. This type of adapter also avoids harmful stresses during an adjustment of the working unit or actuating unit.

This apparatus for joining at least one actuator to at least one oblong working unit of a coating system, allowing translatory and/or rotatory adjustment, includes at least one coupling system which connects the actuator and the oblong working unit to each other without play. The apparatus also includes at least one joint system that is coordinated with the actuator, oblong working unit and/or coupling system. The joint system is free of play while having two joint axes that are substantially parallel to the longitudinal expanse of the oblong working unit. The joint system may be a system with "genuine" joints, that is, joints including at least two components, namely a stationary component and another component movable thereto. The joint system may also be a mixed form of such "genuine" joint that, similarly to the previously illustrated bending-elastic force transmission element, achieves the mobility of a specific area or component across at least one elastic bending point. Such an elastic bending point can be, for example, a local thin spot or a bending spring arrangement or the like.

This apparatus, too, possesses the advantages already illustrated in detail.

The joint system of the apparatus includes two joint elements that are arranged, without play and spaced from one another, between the actuator system and the oblong working unit. Thereby, manufacturing tolerances and any installation inaccuracy can be evened out in the assembly. Also, the force effect of the actuating system can be transmitted without play and stress to the oblong working unit in the operation. The compensating mechanism being contained between the actuating system and the working unit, the actuating system can be attached rigidly to an appropriate mounting section of the coating system without appreciable expense.

In a further embodiment, the joint system includes two joint elements that are free of play and of which one is arranged between the actuator and the oblong working unit. The other joint element is arranged between the actuator and an abutment of the coating system coordinated with the actuator. The abutment itself may form one of the two joint elements. This configuration also possesses the aforementioned compensating and force transmission functions.

According to a further configuration feature, the coupling system includes the joint system or vice versa. The coupling system or joint system thus assumes a double function, thereby reducing the number of components of the inventional apparatus and also shortening and facilitating the necessary assembly work.

The coupling system of each of the inventional apparatuses described above may be of a single-part or multiple-part design.

The coupling system of each of the apparatuses includes, as long as the coupling system is not itself configured as a no-play joint element, at least one prestressing system that guarantees the absence of play in the coupling system. Such a prestressing system, e.g., may be an elastomer material inserted between the two halves of the coupling system. Alternatively, the prestressing system may be a spring system, such as disk springs or the like, which tend to spread apart or squeeze together the meshing coupling halves, creating a no-play connection.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
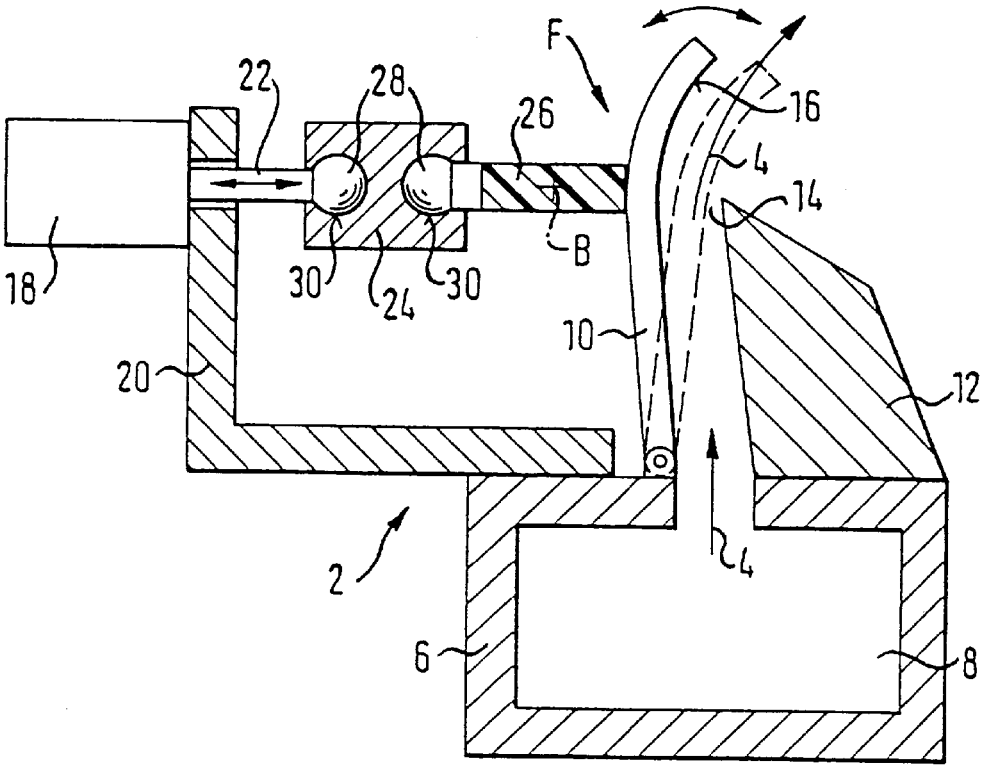
FIG. 1 is a schematic cross-sectional illustration of a first embodiment of the inventional apparatus in the area of an oblong working unit of an applicator of a coating system.

FIG. 1 shows a schematic cross-sectional illustration of a first embodiment of the inventional apparatus in the area of an oblong working unit F of an applicator 2 of a coating system, for example, of a paper machine or paper converting machine. Greatly simplified in the illustration, applicator 2 is configured as an open-jet nozzle applicator. Applicator 2 serves the direct or indirect application of a liquid or pasty coating medium 4 onto a traveling fiber material web, which for the sake of clarity is not illustrated.

Applicator 2 includes a support beam 6 with a feed line 8 through which the pressurized coating medium 4 proceeds into a nozzle slot 14 formed between two lips 10, 12 extending substantially across the entire machine width. From nozzle slot 14, coating medium 4 issues as an open jet extending through the ambient atmosphere. Lip 10, on the free end of which borders a concave deflection surface 16, forms the oblong working unit F adapted for rotatory adjustment. That is, as indicated in the drawing by dashed lines, lip 10 is pivotable uniformly or zonewise across the machine width for adjustment of the nozzle slot width.

Provided for that purpose are a plurality of actuators 18 arranged side by side across the machine width and incorporated in a not illustrated feedback control of the coating system. The actuators 18 are attached rigidly to a holder 20 joined to the support beam 6. An apparatus is provided for transmission of the traction or thrust forces, i.e., tension or compression forces, emanating from a relevant connecting rod 22 of an actuator 18 to the adjustable lip 10. The apparatus joins the actuators 18 to the lip 10 and includes a coupling 24, or fast-action coupling, connecting actuator 18 and lip 10 to one another without play. The left end of coupling 24 is joined with no play to connecting rod 22 of actuator 18. Between the other free end of coupling 24 and adjustable lip 10, based on the working direction of actuator 18 established by connecting rod 22 and indicated by double arrow in the drawing, is a force transmission element 26. Force transmission element 26 is substantially resistant to traction and thrust, is bending-elastic in at least one axis B substantially parallel to the longitudinal expanse of lip 10, and establishes a no-play connection between coupling 24 and movable lip 10. The bending-elastic force transmission element 26 is made of elastomer material. However, a leaf-spring-like metal strip or comparable machine element may be employed as well.

Actuator 18, coupling 24 and bending-elastic force transmission element 26 are joined by a prefabricated adapter system. The latter includes a ball head 28, disposed on the free end of the connecting rod 22 of the actuator 18, which engages with no play a mating socket 30 of coupling 24. The adapter system also includes an analogously configured ball-and-socket joint 28, 30 between coupling 24 and the bending-elastic force transmission element 26. Ball head 28 of the bending-elastic force transmission element 26 may be formed unitarily of the elastomer material of the force transmission element 26 itself. Alternatively, ball head 28 of the bending-elastic force transmission element 26 may be formed of an appropriately shaped metal fitting embedded in the marginal area of force transmission element 26 coordinated with coupling 24. This can be done without impairing the bending-elastic properties of force transmission element 26. The end of the bending-elastic force transmission element 26 that is coordinated with adjustable lip 10 features corresponding suitable fastening devices which also safeguard a no-play joining to lip 10.

Figure 2:
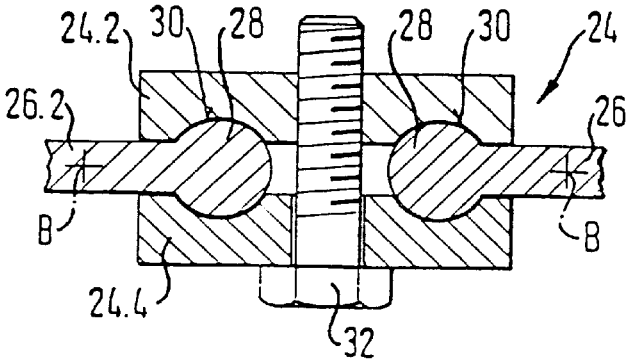
FIG. 2 is a schematic, scaled-up cross-sectional illustration of a second embodiment of the inventional apparatus.

FIG. 2, analogous to the illustration in FIG. 1, shows a scaled-up view of a second embodiment of the inventional joining apparatus. The arrangement and configuration of this apparatus corresponds substantially to that of FIG. 1. In variation thereof, however, a second bending-elastic force transmission element 26.2 is provided between the actuator, not illustrated in FIG. 2, and coupling 24. As follows from FIG. 2, coupling 24 includes of two half-shell halves 24.2, 24.4 held together by a screw joint 32 clamping the ball-headed ends 28 of the two bending-elastic force transmission elements 26, 26.2 in between with no play and immovably.

Figure 3:
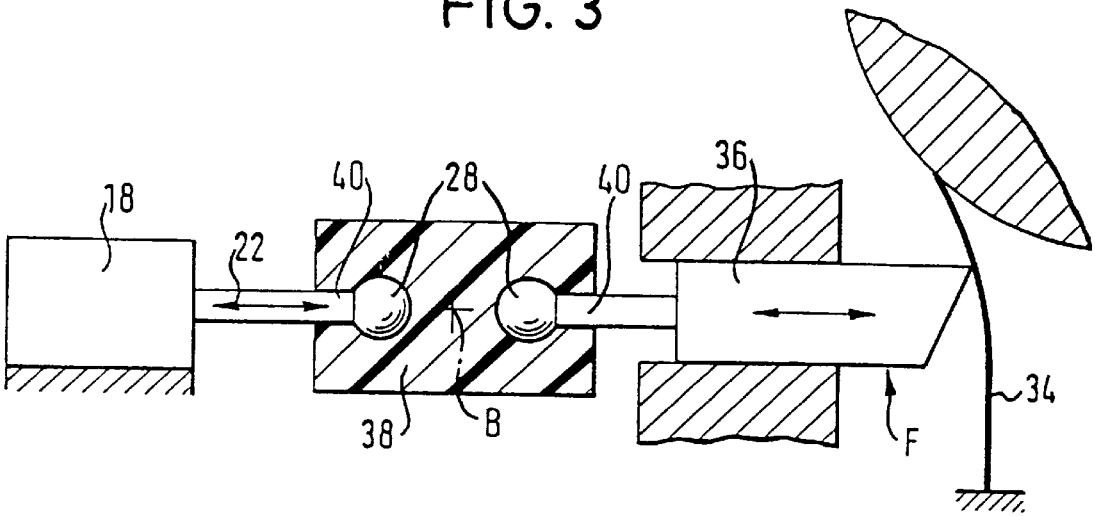
FIG. 3 is a schematic cross-sectional illustration of a third embodiment of the inventional apparatus in the area of an oblong working unit of an applicator of a coating system.

FIG. 3 shows a schematic cross-sectional illustration of a third embodiment of the inventional apparatus in the area of an oblong working unit F of an applicator of a coating system. Oblong working unit F is a translatory adjustable pressure bar 36 acting on a doctor blade 34. Similar to FIG. 1, a relevant actuator 18 is by way of a coupling 38 joined with no play to pressure bar 36. The peculiarity of the configuration variant according to FIG. 3 is constituted in that coupling 38 itself is configured as a force transmission element substantially resistant to traction and thrust with respect to the actuating direction of actuator 18 and is bending-elastic in at least one axis B substantially parallel to the longitudinal expanse of pressure bar 36. Coupling 38 is for that purpose formed integrally or unitarily of an elastomer material. Rigid connecting elements 40 of actuator 18 and pressure bar 36 engage positively and with no play a left-hand and right-hand, respectively, marginal section of coupling 38. Hence, the bending-elastically deformable area of coupling 38 is disposed between these two marginal sections.

Figure 4:
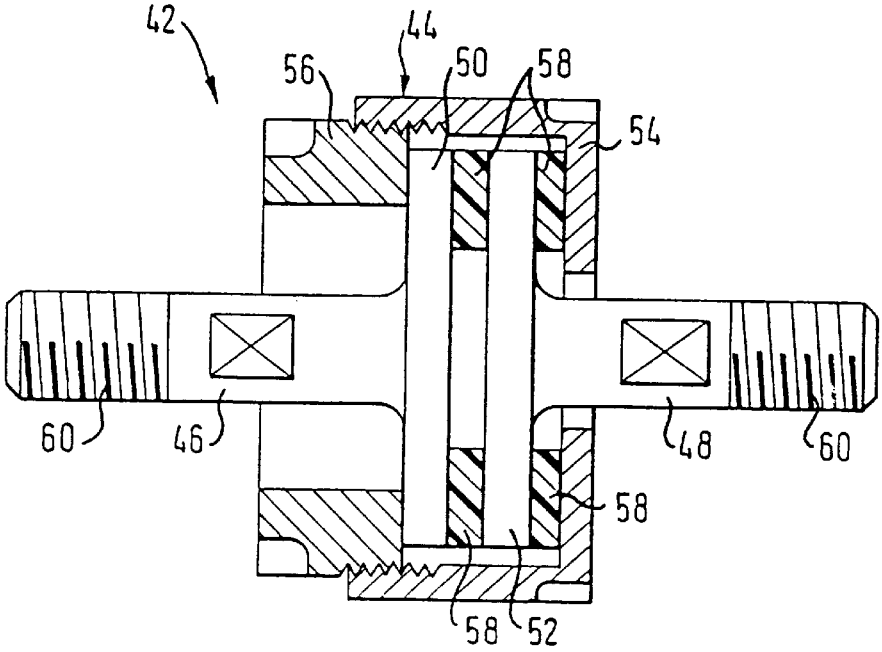
FIG. 4 is a schematic cross-sectional illustration of a fourth embodiment of the inventional apparatus.

FIG. 4 depicts a schematic cross-sectional illustration of a fourth embodiment of the inventional joining apparatus. Similar to the variant of FIG. 3, the coupling 42 itself is configured as a bending-elastic force transmission element. Contrary to FIG. 3, however, coupling 42 is a nonunitary assembly composed of several individual parts and including both rigid and elastic or flexible parts, guaranteeing the particular bending-elastic properties of coupling 42.

Coupling 42 has two cylindrical fittings 46, 48 aligned substantially axially to one another and each protruding with a free end out of a two-part coupling housing 44. The ends of fittings 46 and 48, contained in housing 44, are each equipped with an enlarged end disk 50 and 52, respectively. Axially opposed with a clearance, end disks 50, 52 are secured captively in housing 44 by a union nut 54 and a clamping ring 56 screw-joined to it, the two forming together the coupling housing 44. Provided between the two end disks 50, 52, and also between an end disk 52 and an inside end face of union nut 54, is a disk-like elastic or bending-elastic element 58 made integrally or unitarily of elastomer material. Metallic disk springs or similar may be used instead of elastic elements. Clamping ring 56 is screwed into union nut 54 sufficiently far to force the two fitting elements 46, 48 by way of their end disks 50, 52, against the reset force of the spring elements 58. Thus, fitting elements 46 and 48 are forced at no play, but bending-elastically movably, onto one another and on the inside end face of union nut 54. Depending on how far the clamping ring 56 is screwed in, the prestress force of the elastic elements 58 can be adjusted, thus manipulating the properties of coupling 42. The ends of the fittings 46, 48 protruding out of coupling housing 44 are each provided with a thread 60 for connection to a mating thread of an actuator 18 or the oblong working unit F. Thus, the detachable, no-play joining of coupling 42 to actuator 18 and the oblong working unit F is enabled.

Figure 5A:
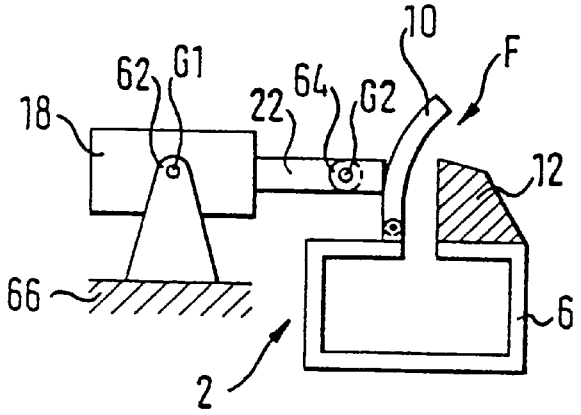
FIG. 5*a* is a schematic cross-sectional illustration of a varient of a fifth embodiment of the inventional apparatus in the area of an oblong working unit of an applicator of a coating system.
Figure 5B:
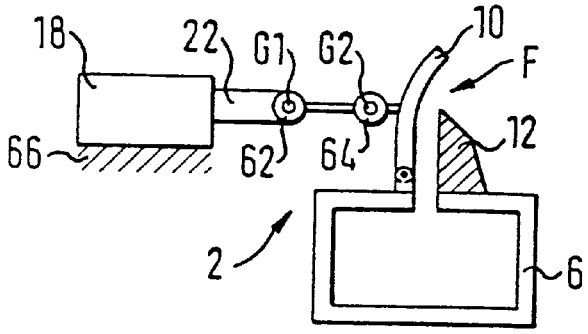
FIG. 5*b* is a schematic cross-sectional illustration of another varient of a fifth embodiment of the inventional apparatus in the area of an oblong working unit of an applicator of a coating system.
Figure 5C:
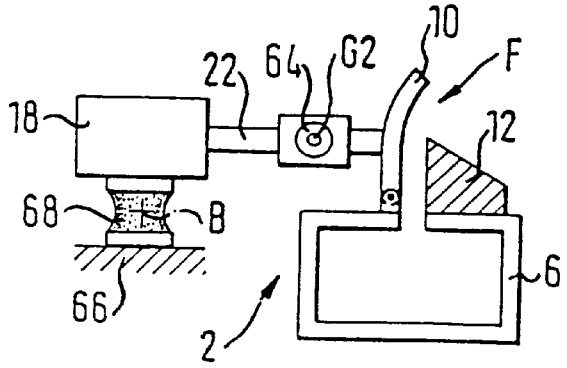
FIG. 5*c* is a schematic cross-sectional illustration of yet another varient of a fifth embodiment of the inventional apparatus in the area of an oblong working unit of an applicator of a coating system.

FIGS. 5*a–c* show schematic cross-sectional illustrations of a fifth embodiment of the inventional apparatus, in three respective variants, in the area of an oblong working unit F of an applicator 2 of a coating system. The structure of applicator 2 and the arrangement of the actuators 18 of the actuating system correspond essentially to that of FIG. 1, making further explanations unnecessary. As opposed to the embodiments described above, the inventional joining apparatus includes here a no-play joint system coordinated with the relevant actuator 18 and the adjustable lip 10 and having two joints 62, 64. Each of joints 62 and 64 features at least one joint axis G1, G2 extending in a direction substantially parallel to the longitudinal expanse of the adjustable lip 10.

In the embodiment according to FIG. 5*a*, the two joints 62, 64 are arranged such that the first joint 62 is contained between actuator 18 and a support surface 66 of the coating system coordinated with the actuator 18, while the second joint 64 is disposed between the actuator 18 and the adjustable lip 10. The first joint 62 also forms the bearing for the actuator 18.

In the embodiment according to FIG. 5*b*, in contrast, the two joints 62, 64 are arranged, mutually spaced, between the actuator 18 and the adjustable lip 10. Actuator 18 is attached rigidly to its support surface 66.

In the variant according to both FIG. 5*a* and 5*b*, the joints 62, 64 are configured as "genuine" joints, that is, joints including at least two components, namely a stationary component and another movable relative to it. Hence, regular revolute joints with one degree of freedom, turn-slide joints with two degrees of freedom, ball-and-socket joints with two or three degrees of freedom, or cam joints with two (plane) or five (spatial) degrees of freedom are suited for this application.

In the embodiment according to FIG. 5*c*, in contrast, a joint system is used which represents a mixed form of a "genuine" joint 64 and a joint 68 achieving its mobility by way of at least one elastic bending point that establishes a bending axis B. Further degrees of freedom, of course, are also possible in this solution. The elastic bending point B in FIG. 5*c* is realized with the aid of a component 68 made of bending-elastic elastomer material. The embodiment according to FIG. 5*c* may also be modified such that the joints 64, 68 are switched.

In the examples sketched in FIG. 5*a* through 5*c*, the no-play joint system itself forms the no-play coupling system that joins the actuator 18 and the oblong lip 10 to one another. It is also possible, of course, to make a coupling system available that is separated from the joint system. The coupling system may be installed, e.g., between actuator 18 and its support surface 66, between a joint 62 or 68 and actuator 18, between a joint 64 and lip 10, between the two joints 62 and 64, or between the two joints 68 and 64.

The invention is not limited to the above exemplary embodiments, which serve merely the general explanation of the basic idea of the invention. Rather, the inventional apparatus may also assume, within the scope of protection, configurations other than those described above. The apparatus may possess features representing a combination of the respective individual features. The inventional apparatus may also be employed in conjunction with oblong working units other than those described. For example, the inventional apparatus may be employed in conjunction with adjustable doctor elements, deflector plates, guide surfaces, support beams, holders and the like. It is possible that the bending-elastic force transmission element, or the coupling configured as such an element, has a cross-sectional shape other than those sketched. For example, cross-sectional shapes with locally thinned or recessed sections creating specific, desired bending properties or a particular orientation of the bending axis are possible. The inventional apparatus compensates with no play and no stress for an angular or level offset based on an axis substantially parallel to the longitudinal expanse of the oblong working unit. However, the inventional apparatus also allows, with suitable configuration of the coupling or of the at least one bending-elastic force transmission element, a compensation for a corresponding offset in additional axes. This is the case, e.g., with the variant according to FIG. 4.

Reference symbols in the claims, description and drawings serve merely the better understanding of the invention and are not meant to limit the scope of protection.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for coating a traveling fiber material web with a coating medium, said apparatus comprising:

at least one oblong working unit associated with the web and having a longitudinal direction, each said oblong working unit being at least one of translatory adjustable and rotary adjustable, said at least one oblong working unit structured and arranged for applying coating medium onto the material web;

at least one actuator having an actuating direction, said at least one actuator being configured for at least one of translatory adjustment and rotatory adjustment of said at least one oblong working unit;

at least one coupling system interconnecting without substantial tolerances said at least one oblong working unit and said at least one actuator; and at least one force transmission element disposed between said at least one coupling system and at least one of said at least one actuator and said at least one oblong working unit, said at least one force transmission element being elastically bendable about at least one axis substantially parallel to said longitudinal direction of said at least one oblong working unit, said at least one force transmission element being substantially resistant to tension and compression in said actuating direction of one said actuator.

2. The apparatus of claim 1, wherein said at least one force transmission element is either detachably or nondetachably joined to at least one of said at least one coupling system, said at least one actuator, and said at least one oblong working unit.

3. The apparatus of claim 1, wherein at least one of said at least one coupling system and said at least one force transmission element comprises an oblong component extending substantially parallel to said longitudinal direction of said at least one oblong working unit.

4. The apparatus of claim 1, wherein at least one of said at least one force transmission element, said at least one coupling system, and said at least one actuator includes at least one first adapter, at least one other of said at least one force transmission element, said at least one coupling system, and said at least one actuator including at least one second adapter, said at least one first adapter and said at least one second adapter being meshed together without substantial tolerances therebetween.

5. The apparatus of claim 4, wherein said at least one first adapter comprises one of a ball head and an arcuate material section.

6. An apparatus for coating a traveling fiber material web with a coating medium, said apparatus comprising:

at least one oblong working unit associated with the web and having a longitudinal direction, each said oblong working unit being at least one of translatory adjustable and rotary adjustable, said at least one oblong unit structured and arranged for applying coating medium onto the material web;

at least one actuator having an actuating direction, said at least one actuator being configured for at least one of translatory adjustment and rotatory adjustment of said at least one oblong working unit; and at least one coupling system interconnecting without substantial tolerances said at least one oblong working unit and said at least one actuator, said at least one coupling system comprising a force transmission element which is elastically bendable about at least one axis substantially parallel to said longitudinal direction of said at least one working unit, said force transmission element being substantially resistant to tension and compression in said actuating direction of said at least one actuator.

7. The apparatus of claim 6, wherein said at least one coupling system includes at least one prestressing system configured for rigidifying said at least one coupling system.

8. An apparatus for coating a traveling fiber material web with a coating medium, said apparatus comprising:

at least one oblong working unit associated with the web and having a longitudinal direction, each said oblong working unit being at least one of translatory adjustable and rotary adjustable, said at least one oblong working unit structured and arranged for applying coating medium onto the material web;

at least one actuator having an actuating direction, said at least one actuator being configured for at least one of translatory adjustment and rotatory adjustment of said at least one oblong working unit;

at least one coupling system interconnecting without substantial tolerances said at least one oblong working unit and said at least one actuator; and at least one no-play joint system coordinated with at least one of said at least one actuator, said at least one oblong working unit and said at least one coupling system, said at least one no-play joint system including two joint axes oriented substantially parallel to said longitudinal direction of said at least one oblong working unit.

9. The apparatus of claim 8, wherein said at least one no-play joint system comprises two no-play joint elements, said two no-play joint elements being spaced from one another, said two no-play joint elements being disposed between said at least one actuator and said at least one oblong working unit.

10. The apparatus of claim 8, further comprising a fixed abutment associated with said at least one actuator, said at least one no-play joint system comprising a first no-play joint element and a second no-play joint element, said first no-play joint element being disposed between said at least one actuator and said at least one oblong working unit, said second no-play joint element being disposed between said at least one actuator and said fixed abutment.

11. The apparatus of claim 10, wherein at least one of said first no-play joint element and said second no-play joint element comprises a bending-elastic joint element.

12. The apparatus of claim 8, wherein said at least one coupling system is integral with said at least one no-play joint system.

13. The apparatus of claim 8, wherein said at least one no-play joint system is integral with said at least one coupling system.

* * * * *